US006186501B1

(12) United States Patent
St. Ours

(10) Patent No.: US 6,186,501 B1
(45) Date of Patent: Feb. 13, 2001

(54) SIGNATURE DIVERTER

(75) Inventor: Joseph Adrian St. Ours, Lee, NH (US)

(73) Assignee: Heidelberger Druckmaschinen AG (DE)

( * ) Notice: Under 35 U.S.C. 154(b), the term of this patent shall be extended for 0 days.

(21) Appl. No.: 09/159,611

(22) Filed: Sep. 24, 1998

(51) Int. Cl.[7] ..... B65H 39/10

(52) U.S. Cl. ..... 271/302; 271/304; 271/272; 271/200

(58) Field of Search ..... 271/302, 303, 271/304, 299, 272, 81, 200

(56) References Cited

U.S. PATENT DOCUMENTS

| | | | | |
|---|---|---|---|---|
| 4,256,299 | * | 3/1981 | Hogenson | 271/302 |
| 4,322,069 | * | 3/1982 | Mitchell | 271/302 |
| 4,373,713 | | 2/1983 | Loebach . | |
| 4,691,914 | * | 9/1987 | Lawrence | 271/302 |
| 4,729,282 | | 3/1988 | Kasdorf . | |
| 4,890,826 | * | 1/1990 | Rutishauser | 271/302 |
| 4,930,383 | | 6/1990 | Köbler . | |
| 5,064,180 | | 11/1991 | Wingate . | |
| 5,538,242 | | 7/1996 | Doucet . | |
| 5,702,100 | | 12/1997 | Novick et al. . | |

FOREIGN PATENT DOCUMENTS

| | | | | |
|---|---|---|---|---|
| 0 297 282 B1 | | 1/1989 | (EP) . | |
| 0 436 404 A2 | | 7/1991 | (EP) . | |
| 0048151 | * | 4/1980 | (JP) | 271/302 |
| 0143162 | * | 6/1988 | (JP) | 271/302 |
| 0300058 | * | 12/1990 | (JP) | 271/303 |
| 403227870 | * | 10/1991 | (JP) | 271/302 |

OTHER PUBLICATIONS

European Search Report issued Aug. 14, 2000.

* cited by examiner

*Primary Examiner*—H. Grant Skaggs
(74) *Attorney, Agent, or Firm*—Burns, Doane, Swecker & Mathis, L.L.P.

(57) ABSTRACT

The present invention is directed to a diverter mechanism for use in a web fed rotary printing press, that is simple, low in mass, provides positive control of signatures passing through it, and can be located close to elements or mechanisms within the printing press for receiving signatures that have passed through the diverter mechanism. The diverter mechanism includes a nip formed using two cylinders. The nip can be rotated around an axis formed by the center of the nip, or can be rotated around a rotational axis of one of the two cylinders, to selectively aim a signature exiting from the nip at one of two or more receiving devices.

18 Claims, 4 Drawing Sheets

SIGNATURE DIVERTER

BACKGROUND OF THE INVENTION

1. Field of the Invention

The present invention relates generally to a mechanism for diverting signatures in a web fed rotary printing press, for example within a folder unit of the printing press.

2. State of the Art

Commercially available web fed rotary printing presses typically include printing units arranged at fixed locations in the press room. After the web has moved through the printing units, it is transported to folder and cutter units that fold the web and cut the web lengthwise and crosswise into printed products, such as signatures used to create newspapers, magazines, and the like. The web is cut into signatures that are typically conveyed to a fan or other delivery system, which deposits them on, for example, a conveyor belt. The printing press can be configured so that signatures are evenly diverted among several fans or other delivery systems using a diverter mechanism. Known diverters can undesirably mark the web and signatures cut therefrom. Known diverters also lack positive control over the web and signature transport path, which can lead to additional web and signature damage, and to jamming of the press.

One known diverter illustrated in FIGS. 1A and 1B includes a wedge 108 that is rotatable to divert signatures to one side of the web or to the other side of the wedge. The wedge is placed in a signature stream path 101 with an apex of the wedge facing the oncoming stream. There is a gap between consecutive signatures traveling along the paper stream path. At each gap, the wedge 108 can be rotated so that the wedge 108 will deflect the next signature to the other side of the apex. Such a configuration typically includes a nip 102 located upstream of a cutter 104 having first and second cutting cylinders 105 and 107, and a nip 106 located downstream of the cutter 104. Signatures exiting the nip 106 are deflected by the wedge 108 to either of the fans 110, 112 shown in FIG. 1A, or to either of the conveyor paths 114, 116 shown in FIG. 1B.

Such a diverter mechanism has several disadvantages. For example, the movable wedge can cause marking of images printed on the signatures and an increased risk of having signatures jam in the printing press. The wedge also lengthens a distance the signatures travel without being under positive control, because the signatures are not under positive control as they travel along the sides of the wedge. A lack of positive control increases a likelihood that the web and signatures will not travel precisely and smoothly through the printing press, and increases potential jamming, potential misalignments, and potential wrinkling, tearing, and signature damage.

Other diverters suffer similar drawbacks. For example, U.S. Pat. No. 4,373,713 to Loebach discloses a sheet diverter located in a stream of signatures and having a pair of movable diverting cylinders provided adjacent to the signature stream. U.S. Pat. No. 4,729,282 to Kasdorf describes a diverter including a stationary wedge located with an apex pointed into a signature flow direction, and two diverter rolls forming a nip, each of the diverter rolls having an eccentric rotational axis. However, the diverters described in these patents have several disadvantages.

For example, U.S. Pat. No. 4,373,713 to Loebach requires a matching of the speeds of two diverter cylinder surfaces with the speeds of the signatures to minimize marking and to maintain a smooth flow through the diverter. Different diverting cylinders are required for each signature size, and the distance which the diverting cylinders will deflect the paper stream depends on camming surface contours included on the diverter cylinder surfaces and on radii of the diverting cylinders, which are typically not adjustable. Because the camming surfaces do not firmly grasp signatures passing between the diverting cylinders, the signatures are not under positive control as they pass between the diverting cylinders over a distance equal to at least an average diameter of one of the diverting cylinders.

U.S. Pat. No. 4,729,282 to Kasdorf requires that rotation of two diverter rolls be carefully synchronized. In addition, the wedge used lengthens a distance the signatures must travel without being under positive control, and the wedge can cause marking.

U.S. Pat. No. 5,538,242 to Doucet discloses a signature aiming device having two cylinders that are offset along an axis of a signature flow path. The device is provided with tapes or belts that flow along substantially the same path to the cylinders, and then partially wrap around each cylinder and flow away from the cylinders in different directions. Signatures flowing along the path toward the two cylinders are sandwiched between the tapes until they are released when the tapes diverge as they wrap around the cylinders.

However, the device disclosed in the Doucet patent does not maintain positive control over signatures throughout the transport path. The signatures are transported by pressing the signatures between two tapes, and tapes provide less positive control than nips that firmly grip the signatures. The tapes also increase overall complexity of the device, and any difference in speed between the two tapes can damage the signatures and increase the likelihood of jamming within the printing press. Furthermore, staggering the two cylinders as disclosed in the Doucet patent requires a distance between the two cylinders along the signature flow path, where the signatures are unsupported on one side. At a minimum, the signatures are not positively controlled over the sum of the distance between the two cylinders along the signature flow path, and the distance between the last cylinder and a receiving mechanism, such as a fan or another tape transport system. The absence of positive control over the transport path can lead to damage of the web and signatures, and to jamming of the press.

U.S. Pat. No. 5,702,100 to Novick et al. discloses a diverter for signatures in a folder apparatus within a printing press. A set of high-speed tapes convey signatures to a diverter, which selectively redirects the signatures. The diverter of the Novick patent includes two rotating assemblies which each include at least two rollers. When the assemblies are rotated in coordinated fashion, the outer edges of the rotating assemblies describe overlapping arcs.

The diverters illustrated in the Novick patent have several disadvantages. For example, rotation of both assemblies must be carefully coordinated to alter the exit angle from the nip. This coordinated rotation requires a relatively complex actuator/control mechanism that is powerful enough to rotate the assemblies with a speed sufficient keep up with the flow of signatures between the assemblies. In addition, the diverters shown in the Novick patent use tapes which result in a loss of positive control over the web and signatures, and that can lead to damage of the signatures and jamming of the presses.

European Patent Application No. EP 0 297 282 B1 discloses cutting cylinders that are moved together as a unit laterally with respect to a web path that flows between the cutting cylinders. For example, FIGS. 1 and 2 of the European Patent Application show cut signatures flowing out from between cutting cylinders 7 and 8 on one side or the other of a wedge 15, and being guided to one of two receiving paths formed by tapes 16, 17 and 21. However, the use of the wedge 15 and associated tapes has various disadvantages such as marking of the signatures and a loss of positive control.

Accordingly, it would be desirable to provide a diverter that will accommodate high press speeds, without marking or otherwise damaging the web and signatures. It would also be desirable to provide a diverter that can permit positive control over the web and signatures to be maximized so that the potential for damage to the web and signatures, and the potential for press jamming, can be minimized.

SUMMARY OF THE INVENTION

The present invention is directed to a diverter mechanism for use in a web fed rotary printing press, that is simple in construction and operation, is low in mass, provides positive control of signatures passing through it, and can be located close to elements or mechanisms within the printing press for receiving signatures that have passed through the diverter mechanism. The diverter mechanism can be configured with or without tapes, and yet maximize positive control over the web and signatures throughout a diversion operation.

In accordance with a first exemplary embodiment of the invention, two cylinders form a nip through which signatures pass. One of the cylinders has a fixed rotational axis, and the other cylinder can have its rotational axis move to describe an arc, such that an exit angle of the nip formed by the two cylinders changes, while a distance between the rotational axes of the two cylinders remains constant.

In accordance with a second exemplary embodiment of the invention, the cylinders are yoked together by a frame, and the exit angle of the nip formed by the two cylinders is changed by rotating the frame about an axis parallel to, and equidistant between, the rotational axes of the cylinders.

Thus, a web or signature passing through the nip can be directed by rotating the nip about one of: a) a rotational axis of one of the first and second cylinders, and b) a center of the nip, to orient the nip in a specified direction.

Exemplary embodiments are directed to an apparatus, such as a diverting device, either individually or in combination with multiple receiving devices of a web fed printing press, the diverting device comprising: first and second cylinders forming a nip between said first and second cylinders; and a mechanism for changing a transport direction of said nip by rotating the nip about one of: a rotational axis of one of the first and second cylinders; and a center of the nip.

BRIEF DESCRIPTION OF THE DRAWINGS

Other objects and advantages of the present invention will become apparent to those skilled in the art from the following detailed description of preferred embodiments, when read in conjunction with the accompanying drawings wherein like elements have been designated with like reference numerals and wherein.

DETAILED DESCRIPTION OF THE PREFERRED EMBODIMENTS

Figure 1A:
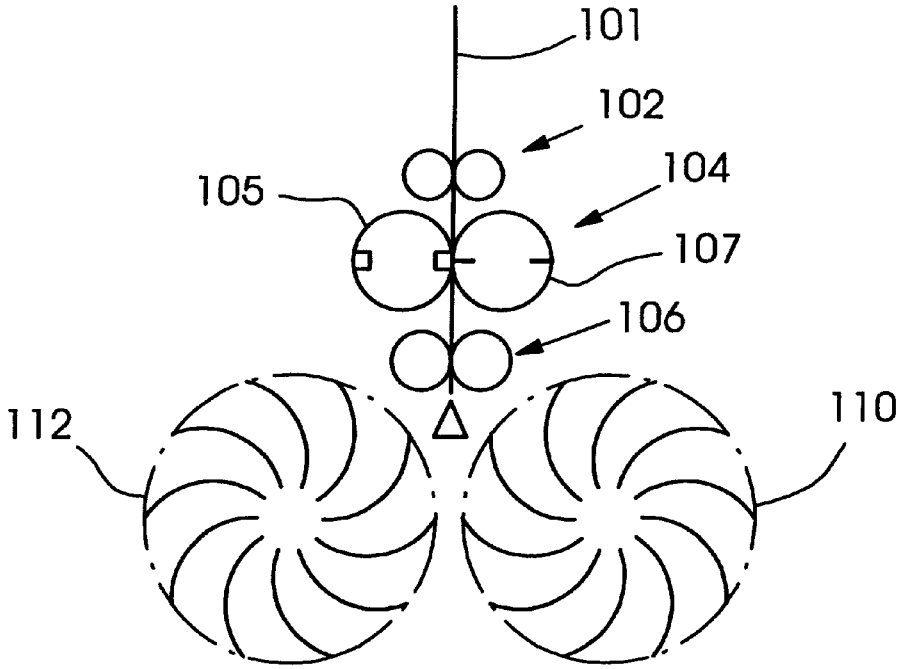
FIGS. 1A and 1B illustrate known diverter mechanisms.
Figure 1B:
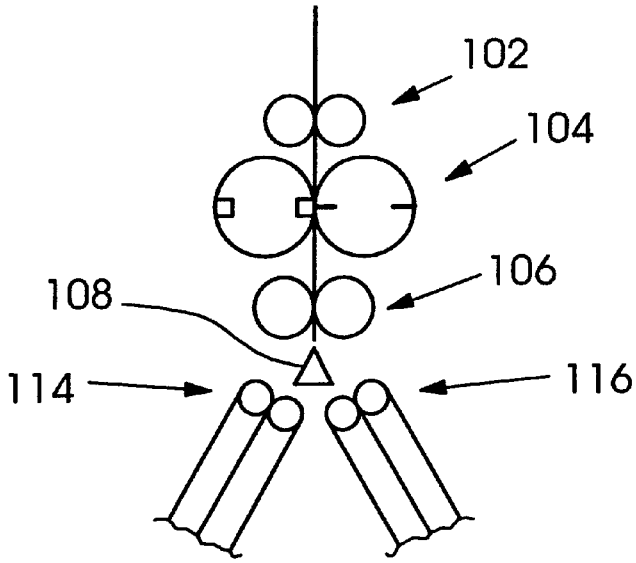
Figure 2A:
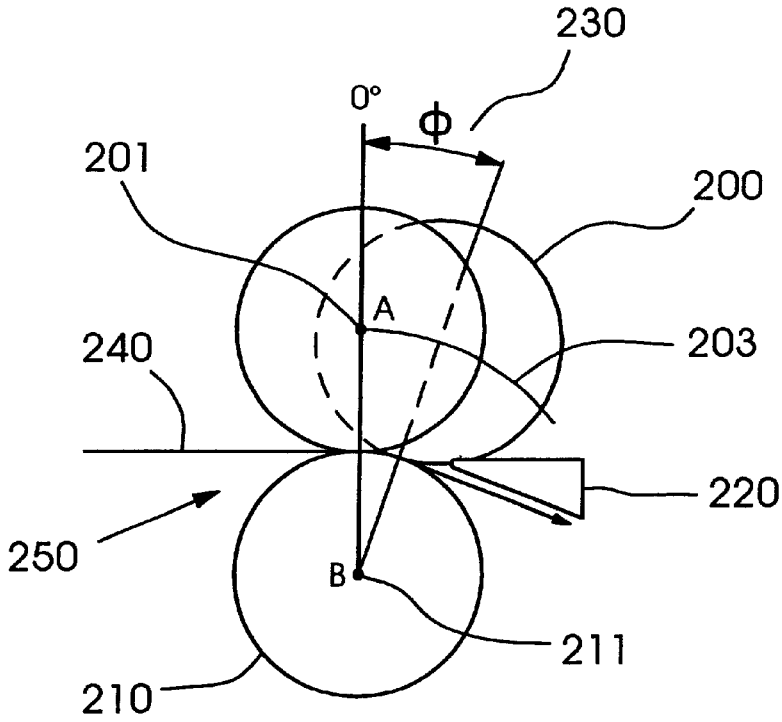
FIGS. 2A and 2B show a side view of a diverter mechanism in accordance with an exemplary embodiment of the present invention.
Figure 2B:
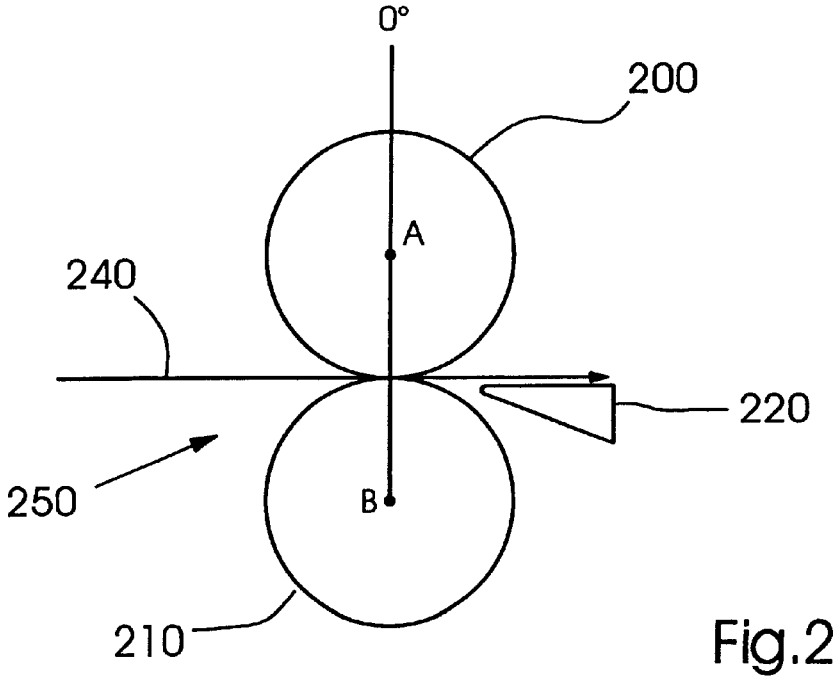

As shown in FIG. 2A, a lead roll 200 and a lag roll 210 together form a nip 250 between the cylinders, through which a signature 240 passes in accordance with an exemplary embodiment of the invention. An exit direction of the signature 240 from the nip 250 can be changed by providing a mechanism by which a rotational axis 201 of the lead roll 200 can be moved along an arc 203 about a rotational axis 211 of the lag roll 210, so that a distance between the rotational axes 201 and 211 of the lead and lag rolls 200 and 210 remains constant. Thus, a diverting device is provided for alternately establishing a transport path toward multiple receiving devices. That is, when the lead roll 200 is rotated forward, the nip is rotated about the axis 211 and the signature 240 will pass beneath the wedge 220 as shown in FIG. 2A. When the lead roll 200 is rotated back, the signature 240 will pass above the wedge 220 as shown in FIG. 2B. In alternate embodiments, the wedge 220 can be omitted, and either roll can be configured as the movable lead roll. The lead roll can be moved along the arc in accordance with techniques and mechanisms well known in the art such as, for example, a cam, a cam follower and a lever connected from the cam follower to the rotational axis 201, as will be described with respect to FIG. 3 embodiment.

Figure 3:
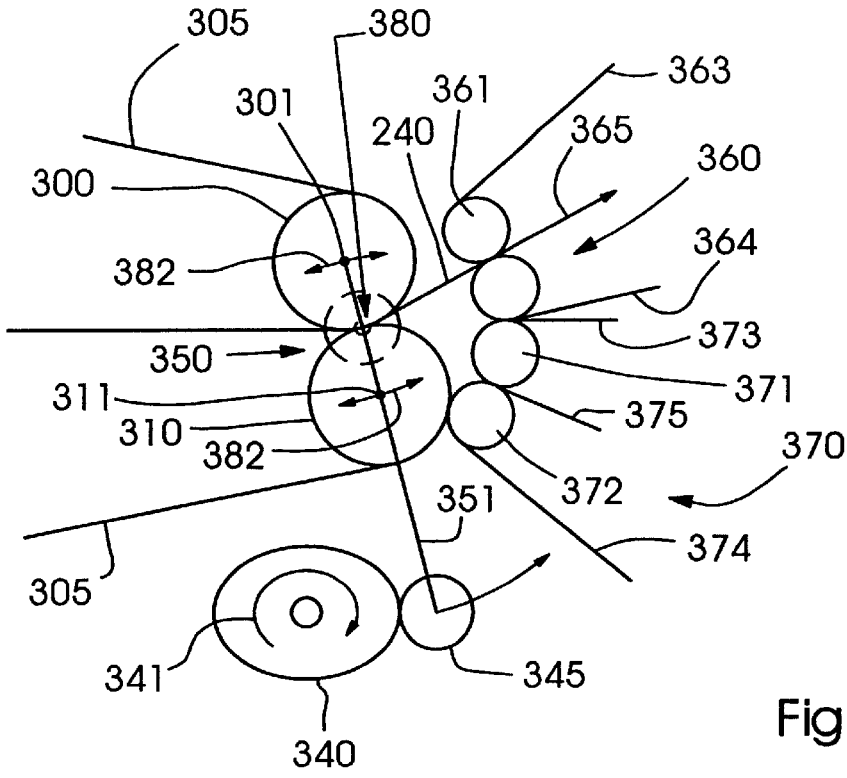
FIG. 3 shows a side view of a diverter mechanism in accordance with an exemplary embodiment of the present invention.

FIG. 3 shows another exemplary embodiment in accordance with the invention, wherein two cylinders 300 and 310 form a nip 350 through which a signature 240 passes. The cylinders 300 and 310 are mounted in a yoke 351, so that a distance between rotational axes 301 and 311 of the cylinders 300 and 310 remains substantially constant (for example, subject to necessary adjustment by an operator of the press to accommodate signatures having different thicknesses). The yoke 351 can be mounted so that when it is rotated, the axes 301 and 311 of cylinders 300 and 310 travel along arcs 382 of a circle whose center 380 is located equidistant between the axes 301 and 311 on a line intersecting the two axes 301 and 311.

As can be seen from FIG. 3, the center or pivot point 380 is the center of the nip 350 formed by the cylinders 300 and 310. Tapes 305 can be provided to guide the signature 240 to the nip. As shown in FIG. 3, the cylinders 300 and 310 are positioned so that a signature 240 exits the nip 350 toward another nip 360, which can be provided with tapes 363 and 364 to convey the signature 240 out of the nip 360. The signature 240 and the tapes 363 and 364 form a sandwich 365, with the signature 240 between the tapes 363 and 364. The nip 360 is formed by two cylinders 361 and 362.

A mechanism for changing a transport direction of the nip includes a roller 345 provided at the end of a lever arm of the yoke 351, which constitutes a cam follower that presses against a surface of a rotatable cam 341. Rotation of the cam 341 moves the roller 345 and thus the yoke 351 so that the cylinders 300 and 310 move along the arc 382, aiming the exit direction of the nip 350 and an exiting signature 240 at either the nip 360 or a nip 370.

The nip 370 is similar to the nip 360, and is formed by cylinders 371 and 372, and tapes 373 and 374. The tapes 373 and 374 form a sandwich 375 that moves away from the nip 370, and which guides a signature 240 between the tapes 373 and 374 when the nip 350 and the signature 240 are aimed at the nip 370.

Figure 4:
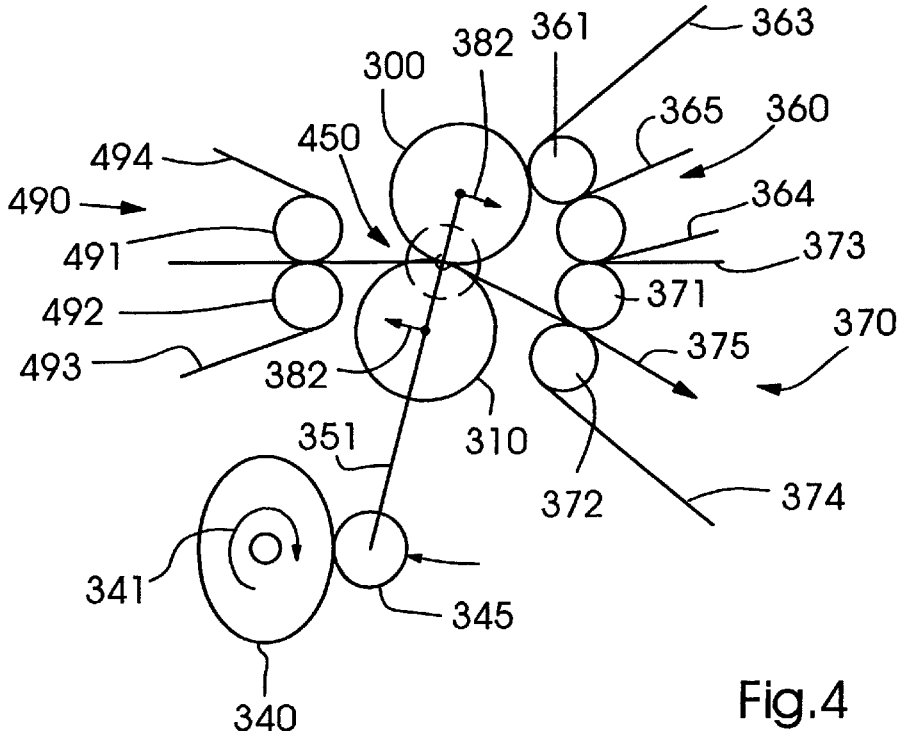
FIG. 4 shows a side view of a diverter mechanism in accordance with an exemplary embodiment of the invention.

The device shown in FIG. 4 is similar to FIG. 3. However, in FIG. 4, a nip 450 formed by cylinders 300 and 310 is not provided with tapes. Instead, an additional nip is provided prior to the nip 450, and is formed by two cylinders 491 and 492 and tapes 494 and 493 that convey the signature 240 toward the nip 450. The nip 450 is shown in FIG. 4 with the signature 240 aimed at the lower nip 370.

Figure 5:
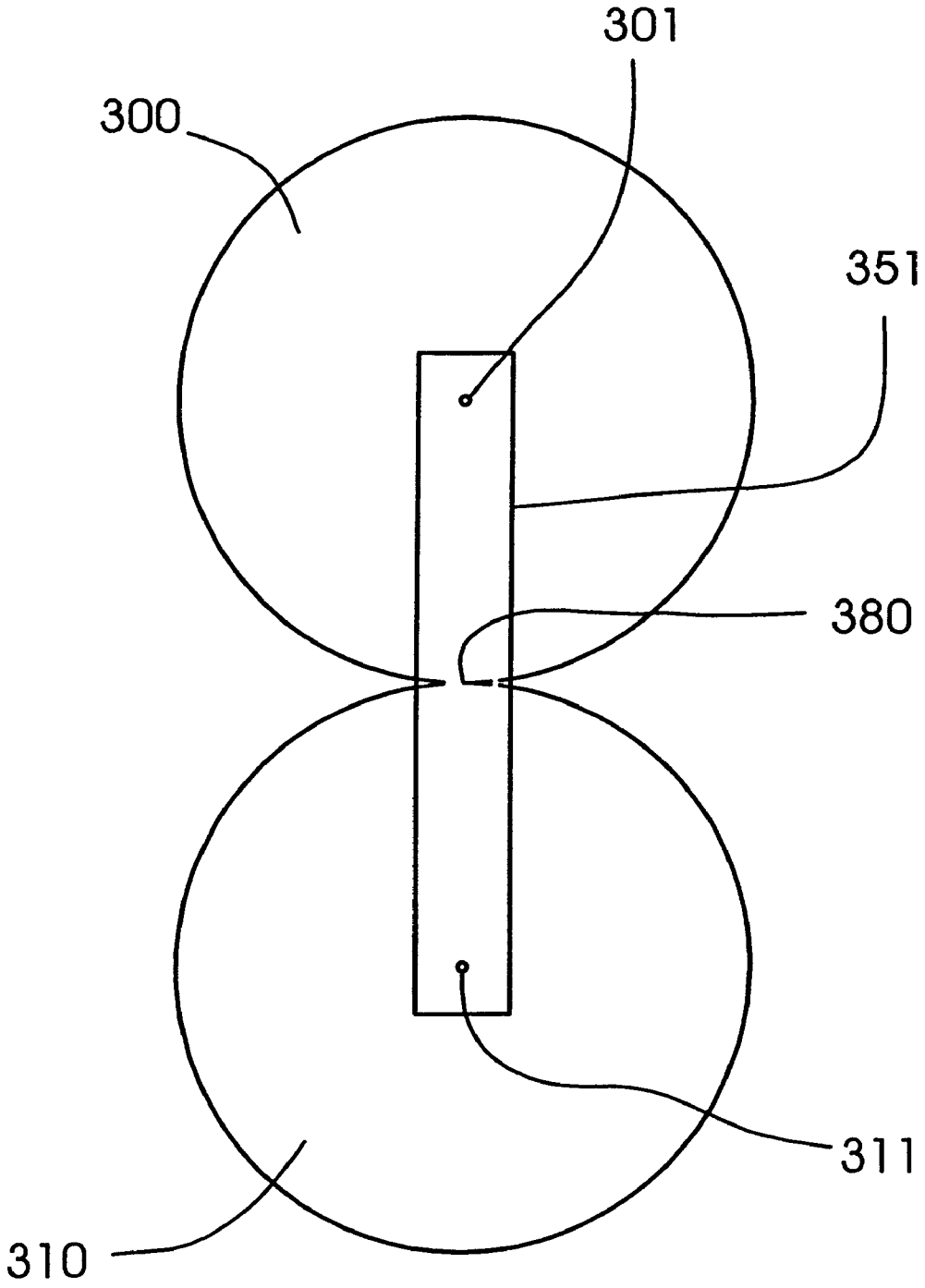
FIG. 5 shows an exemplary yoke for use with the embodiments shown in FIGS. 3 and 4.

FIG. 5 shows an implementation of the yoke 351 in greater detail. As shown in FIG. 5, the yoke can be a rigid structure. As described above with respect to FIGS. 3 and 4, the yoke 351 can be configured to pivot about the pivot point 380. Other techniques and mechanisms well known in the art can alternatively be used to appropriately position the rotational axes 301 and 311 along the arc 382. Furthermore, the yoke 351 can be configured to pivot about one of the rotational axes 301 and 311, and can thus be used with the embodiment shown in FIGS. 2A and 2B.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A web-fed printing press including a diverting device in combination with multiple receiving devices wherein the diverting device comprises:

first and second cylinders forming a nip between the first and second cylinders;

at least a first belt passing through the nip and wrapping at least a portion of the first cylinder; and at least a second belt passing through the nip and wrapping at least a portion of the second cylinder, wherein the first and second belts convey signatures to the nip; and a mechanism for changing a transport direction of said nip by rotating the nip about a rotational axis that is parallel to the rotational axes of the first and second cylinders.

2. The printing press of claim 1, wherein the diverting device further comprises:

a yoke which rotates said first and second cylinders about said center of the nip.

3. The printing press of claim 2, wherein the diverting device further comprises:

a cam follower fixedly attached to said yoke for rotating said yoke.

4. The printing press of claim 3, wherein the diverting device further comprises:

a rotatable cam surface for displacing said cam follower to rotate said yoke.

5. The web-fed printing press of claim 1, wherein the first and second belts do not convey the signatures away from the nip.

6. The press of claim 5, wherein the press further comprises:

at least first and second receiving nips downstream of the first and second cylinders for receiving the signatures, wherein each of the receiving nips includes two cylinders and two belts, one of the two belts passing through the receiving nip and wrapping at least a portion of one of the two cylinders and the other of the two belts passing through the nip and wrapping at least a portion of the other of the two cylinders, wherein the two belts convey the signatures away from the receiving nip, sandwiched between the two belts.

7. The press of claim 6, wherein a center of the nip formed between the at least first and at least second belts does not change position relative to at least first and second receiving nips during operation of the diverting device.

8. The press of claim 1, wherein the nip rotational axis is equidistant from the rotational axes of the first and second cylinders.

9. The press of claim 1, wherein the nip rotational axis coincides with a center of the nip.

10. A web-fed printing press including a diverting device in combination with multiple receiving devices wherein the diverting device comprises:

first and second cylinders;

at least a first belt wrapping at least a portion of the first cylinder; and at least a second belt wrapping at least a portion of the second cylinder, wherein the first and second cylinders press the first and second belts towards each other to form a nip between the first and second belts, and the first and second belts convey signatures to the nip; and the diverting device further comprises a mechanism for changing a transport direction of said nip by rotating the nip about a rotational axis that is parallel to the rotational axes of the first and second cylinders.

11. The printing press of claim 10, wherein the diverting device further comprises:

a yoke which rotates said first and second cylinders about said center of the nip.

12. The printing press of claim 11, wherein the diverting device further comprises:

a cam follower fixedly attached to said yoke for rotating said yoke.

13. The printing press of claim 12, wherein the diverting device further comprises:

a rotatable cam surface for displacing said cam follower to rotate said yoke.

14. The press of claim 10, wherein the nip rotational axis is equidistant from the rotational axes of the first and second cylinders.

15. The press of claim 10, wherein the nip rotational axis coincides with a center of the nip.

16. The press of claim 10, wherein the press further comprises:

at least first and second receiving nips downstream of the first and second cylinders for receiving the signatures, wherein each of the receiving nips includes two cylinders and two belts, one of the two belts passing through the receiving nip and wrapping at least a portion of one of the two cylinders and the other of the two belts passing through the nip and wrapping at least a portion of the other of the two cylinders, wherein the two belts convey the signatures away from the receiving nip, sandwiched between the two belts.

17. The press of claim 16, wherein a center of the nip formed between the first and second belts does not change position relative to at least first and second receiving nips during operation of the diverting device.

18. The press of claim 17, wherein the first and second belts do not convey the signatures away from the nip between the first and second belts.

* * * * *